United States Patent [19]

Suzuki et al.

[11] 3,932,210

[45] Jan. 13, 1976

[54] METHOD OF DISPERSING HYDROXYMETHYL CELLULOSE XANTHATE FIBERS

[75] Inventors: Migaku Suzuki, Ohtake; Atushi Kawai, Hiroshima, both of Japan

[73] Assignee: Mitsubishi Rayon Co., Ltd., Tokyo, Japan

[22] Filed: June 18, 1974

[21] Appl. No.: 480,389

[30] Foreign Application Priority Data

June 18, 1973 Japan ..... 48-68506

[52] U.S. Cl. ..... 162/157 C; 162/158; 162/183; 252/357; 264/194

[51] Int. Cl.[2] ..... D21F 11/06; D21H 3/12

[58] Field of Search ..... 162/157 C, 158, 183; 8/137, 137.5; 264/194; 252/357; 260/404.5

[56] References Cited

UNITED STATES PATENTS

| | | | |
|---|---|---|---|
| 3,072,690 | 1/1963 | Lee et al. | 252/357 X |
| 3,262,951 | 7/1966 | Katz | 252/357 X |
| 3,320,117 | 5/1967 | Aoki et al. | 162/157 C |
| 3,718,537 | 2/1973 | Kawai et al. | 162/157 C |
| 3,832,281 | 8/1974 | Kawai et al. | 162/157 C |

*Primary Examiner*—S. Leon Bashore
*Assistant Examiner*—Arthur L. Corbin
*Attorney, Agent, or Firm*—Oblon, Fisher, Spivak, McClelland & Maier

[57] ABSTRACT

Non-woven fabric or paper-like material having excellent properties can be produced from fibers comprising hydroxymethyl cellulose xanthate by treating the fibers with a water soluble acid salt of aminoethylethanolamine monostearylamide.

6 Claims, No Drawings

METHOD OF DISPERSING HYDROXYMETHYL CELLULOSE XANTHATE FIBERS

BACKGROUND OF THE INVENTION

1. Field of the Invention

The present invention relates to a method for producing non-woven fabrics or paper-like materials having excellent properties by a wet method from fibers comprising hydroxymethyl cellulose xanthate, namely, a derivative of cellulose xanthate.

2. Description of the Prior Art

Hydroxymethyl cellulose xanthate is a methylolation product of cellulose xanthate. Its fibers are strongly acidic and stable, but are characterized by quite high chemical reactivity. These types of fibers and a method for producing non-woven fabrics or paper-like materials from the fibers are disclosed in U.S. Pat. No. 3,718,537 and U.S. Ser. No. 267,994 filed June 30, 1972, now U.S. Pat. No. 3,832,281 (corresponding to Italian Pat. No. 962,732).

These types of fibers have not heretofore been entirely successfully used in a wet process preparation of non-woven fabrics or paper-like materials, and it is now believed that the prior failures are attributable to an inability to properly disperse or distribute the fibers in water. The use of dispersing accelerators have been considered, but heretofore, the high reactivity of the fibers have hindered effective use of such agents. It has now been discovered that a suitable such agent must have the properties of being:

1. acidic
2. highly water-soluble
3. essentially chemically non-reactive with the fibers and cause no denaturation of the fibers
4. highly stable with respect to polyethylene oxide, polyacrylamide or the like, which are often used as dispersion stabilizing agents.

Accordingly, a need continues to exist for an improved wet process technique of forming non-woven fabrics or paper-like materials from hydroxymethyl cellulose xanthate fibers.

SUMMARY OF THE INVENTION

The objects of this invention are provided by the use of a water soluble acid salt of aminoethylethanolamine monostearylamide to impart good self-dispersibility to the fibers. The salt is used in an aqueous acidic medium so as to effect good dispersibility to the hydroxymethyl cellulose xanthate.

DETAILED DESCRIPTION OF THE PREFERRED EMBODIMENT

According to the present invention, fibers which can be used in preparing non-woven fabrics or paper-like materials comprising hydroxymethyl cellulose xanthate are treated with an acid salt of aminoethylethanolamine monostearylamide, as a dispersing accelerator in order to effect a good dispersion of the fibers in an acidic aqueous medium. The amide used herein has the formula: $C_{17}H_{35}CONHCH_2CH_2NHCH_2CH_2OH$ which may be obtained, e.g., by the following reaction:

$$\underset{\text{stearic acid}}{C_{17}H_{35}COOH} + \underset{\text{Aminoethyl ethanolamine}}{H_2NCH_2CH_2NHCH_2CH_2OH} \xrightarrow{160\text{–}200^\circ C}$$

-continued $$C_{17}H_{35}CONHCH_2CH_2NHCH_2CH_2OH + H_2O$$

The amide itself is difficultly soluble, but may be made water-soluble by converting it into its corresponding acid salt. The preferred salts are the lactate and the acetate.

The dispersion accelerating effect of the surfactant used in the present invention is considered to be due to the conjugated effect of i. change in electric charge of the fiber surface caused by the surfactant,
ii. adsorbability of the surfactant onto the fiber surface, and
iii. reduction in abrasion resistance by lubricating agent's effect in water.

As indicated above, the fibers used in the present invention are those comprising hydroxymethyl cellulose xanthate as are described in U.S. Pat. No. 3,718,537 and U.S. Ser. No. 267,994. The fibers are cut into lengths of 4–40 mm while wet and are used in the conventional paper-making process as disclosed in said patents.

The method for using the surfactant of the present invention will now be explained. The starting fibers may be dipped into a liquid containing the above surfactant under acidic conditions, or the liquid may be sprayed or applied onto the fibers under acidic conditions at the spinning step or at any of the stretching or the subsequent steps. By subjecting the fibers to these treatments, a spontaneous dispersibility is imparted to the fibers. The thus treated fibers can then be dispersed in an acidic aqueous solution and used in the conventional wet process technique for the formation of a paper-like product.

The starting fibers may also be directly dispersed into an acidic aqueous solution which contains the surfactant, and the dispersion may be subjected to paper-making.

It becomes possible, by using said surfactant to homogeneously disperse the starting fibers and to produce homogeneous and excellent quality non-woven fabric or paper-like material on an industrial scale.

The preferred concentration of the aqueous solution of the surfactant used for dispersion is 10–100 ppm, although higher concentrations may also be employed if desired.

The preferred amount of the surfactant to be used is 0.05 to 1.5% based on the weight of the fibers.

In the present invention, known dispersion stabilizing agents may, of course, be used in the dispersion step, and the generally employed conditions for dispersion and paper-making may be used without any difficulty.

Paper-making processes from the fibers of the present invention are explained in detail in U.S. Pat. No. 3,718,537 and U.S. Ser. No. 267,994.

In U.S. Ser. No. 267,994, non-woven fabrics or paper-like materials are produced by a. dispersing spun and stretched viscose fibers comprising hydroxymethyl cellulose xanthate in an aqueous medium having a pH of lower than 6.0 at a temperature of lower than 30°C,
b. forming the dispersed fibers into a web by a wet forming method,
c. dehydrating the web to the extent that the water content of the web becomes lower than 700%, said fibers after dehydration being characterized by:

1. a hydroxymethyl cellulose xanthate content in terms of $\gamma$-value of greater than 30,
2. a decomposition degree of less than 75%, and
3. a process swelling degree of lower than 250%, d. subjecting at least a portion of the surface of dehydrated web to a pressure of greater than 2 Kg/cm at a temperature of 90° to 180°C, thereby fusing and decomposing the hydroxymethyl cellulose xanthate in the pressed portion of the fibers and simultaneously bonding the fibers in said portions to each other, and e. subjecting the pressed web to regeneration treatment to decompose the remaining hydroxymethyl cellulose xanthate into cellulose.

Having generally described the invention, a more complete understanding can be obtained by reference to certain specific examples, which are included for purposes of illustration only and are not intended to be limiting unless otherwise specified.

EXAMPLES

A white paste of the lactate of aminoethylethanolamine monostearylamide is prepared as follows:

One mol (284 g) of stearic acid was heated and melted in a 1 liter three neck distillation flask provided with a stirrer, a thermometer and inlet and outlet tubes for nitrogen. Then, the internal temperature was elevated to about 120°C and 1 mol (104 g) of aminoethyl monoethanolamine was added dropwise thereto while avoiding foaming. After completion of the addition, the internal temperature was elevated to 150°–160°C and the reaction was effected for 5–6 hours in a nitrogen stream. Completion of the reaction was confirmed by measuring the acidity and the thus obtained aminoethyl monoethanolamine stearylamide was used in the form of an acid salt as the dispersing accelerator of the present invention. A lactate of this amide was synthesized as follows:

One mol (370 g) of aminoethyl monoethanolamide stearylamide (usually a light yellow solid having a melting point of 65°–70°C, an acid value of 8–13 and a neutralization value of 153–158) was dispersed in warm water of 70°–80°C and was neutralized with 1.5 mol (147 g) of lactic acid to obtain a lactate in an aqueous solution. The reaction schematic is:

$$C_{17}H_{35}CONHCH_2CH_2NHCH_2CH_2OH + CH_3CH(OH)COOH \rightarrow C_{17}H_{35}CONHCH_2CH_2NHCH_2CH_2OH.CH_3CH(OH)COOH$$

Properties of the aminoethyl monoethanol stearylamide lactate are shown in Table 1.

TABLE 1

| Concentration of solid matter (%) | pH | Solubility (%) 20°C | Solubility (%) 60°C | Surface tension (dyn/cm) | Specific viscosity |
|---|---|---|---|---|---|
| 0.1 | 4.05 | 89.2 | 96.5 | 42.1 | 0.987 |
| 0.5 | — | 14.9 | 66.2 | 43.8 | 1.007 |
| 1.0 | 4.75 | 11.0 | 34.0 | 43.8 | 1.036 |

1. Solubility is expressed as transmittance (wave length 650 m$\mu$) of aqueous solutions containing 0.1%, 0.5% and 1.0% of solid matter at 20° and 60°C.
2. pH is the value measured on aqueous solution of 0.1% or 1.0% solid matter concentration at 20°C.
3. Surface tension is measured by the DuNouy method on aqueous solutions of 0.1%, 0.5% or 1.0% solid matter concentration at 20°C.

4. Specific viscosity is measured by the Ostwald method on aqueous solutions of 0.1%, 0.5% or 1.0% solid matter concentration at 20°C.

The lactate was emulsified in water at a concentration of 20–50% to form a white paste. When this was introduced into warm water and agitated, it was immediately converted into a homogeneous and transparent emulsion.

EXAMPLE 1

A white paste containing, as solid matter, 40% of the lactate of aminoethyl ethanolamine monostearylamide (lactate A) was introduced into hot water at 80°C to prepare an aqueous solution having a concentration of 5%. This solution had a pH of 3.5.

A viscose containing 7% cellulose and 4.2% alkali and having a $\gamma$ value of 90 was prepared by the conventional method. This viscose was extruded into a coagulation bath containing 35 g/l of sulfuric acid, 8 g/l of formaldehyde and 80 g/l of sodium sulfate at 26°C. The resultant filaments were stretched by 150% in a second bath containing 10 g/l of sulfuric acid, 3 g/l of formaldehyde and 500 ppm (0.52% based on the weight of fibers) of the lactate at 60°C to obtain a continuous filament tow. This tow was continuously cut into lengths of 20 mm and dispersed in an aqueous solution containing 80 ppm of lactate A and having a pH of 3.2 to obtain an extremely homogeneous dispersion. This dispersion (fiber concentration 0.06%) was immediately subjected to paper making employing a cylindrical paper machine to obtain a sheet of homogeneous texture. The thus obtained sheet was allowed to pass through an embossing roll having projections and having a surface temperature of 150°C to effect partial fusion bonding. The thus treated sheet was then subjected to scouring treatments, such as hot acid treatment at 80°C, water washing, bleaching, or the like and dried.

For comparison, the above procedure was repeated except that lactate A was not used in any steps. The dispersibility in this Example and said Comparative Example are compared in Table 2.

TABLE 2

| | Number of undispersed fibers( /400 cm²) L | M | S | Total |
|---|---|---|---|---|
| The present Example | 0 | 6 | 14 | 20 |
| Comparative Example | 11 | 14 | 36 | 61 |

Method of measurement of number of undispersed fibers:

A square 20 × 20 cm was drawn on the dried sheet as the area to be measured, and this sample was placed on a measuring stand with a fluorescent lamp. Undispersed fibers within said area of 400 cm² were marked with red magic ink and the number of undispersed fibers was counted with a counter. This measurement was effected two times and the mean value was taken as the number of undispersed fibers within said area. In Table 2, "L", "M" and "S" have the following meanings.

L: Undispersed fibers larger than 1.0 mm in width.
M: Undispersed fibers 0.5–1.0 mm in width.
S: Undispersed fibers less than 0.5 mm in width.

EXAMPLE 2

Solution of lactate A was prepared in the same manner as in Example 1. Filaments obtained by spinning in the same manner as in Example 1 were stretched by 150% in a second bath containing 10 g/l sulfuric acid at 60°C to obtain a continuous filament tow. This tow was cut into lengths of 20 mm and at the same time the thus cut fibers were continuously introduced and dispersed in an aqueous solution containing 50 ppm (0.21% based on the weight of fibers) of the lactate and having a pH of 3.5 to obtain an extremely homogeneous dispersion. This dispersion was immediately subjected to a paper-making process employing a cylindrical paper machine to obtain a sheet of homogeneous texture. The thus obtained sheet was passed through an embossing roll having a surface temperature of 135°C to cause partial fusion bonding and then was subjected to scouring treatments, such as hot acid treatment at 80°C, water washing, bleaching, or the like and dried.

For comparison, the above procedure was repeated except that the fibers were dispersed in an aqueous solution containing no lactate. Table 3 shows the comparison of dispersibility in this Example and the Comparative Example

TABLE 3

| | Number of undispersed fibers ( /400 cm²) | | | |
|---|---|---|---|---|
| | L | M | S | Total |
| The present Example | 1 | 9 | 14 | 24 |
| Comparative Example | 11 | 21 | 46 | 78 |

Having now fully described the invention, it will be apparent to one of ordinary skill in the art that many changes and modifications can be made thereto without departing from the spirit or scope of the invention as set forth herein.

What is claimed as new and intended to be covered by letters patent is:

1. In a method for producing a non-woven fabric or a paper-like material by cutting fibers comprising hydroxymethyl cellulose xanthate, dispersing the cut fibers in an acid aqueous medium and then forming the dispersed fibers into a sheet, the improvement which comprises treating said fibers with a water soluble acid salt of aminoethylethanolamine monostearylamide under acidic conditions so as to impart good self dispersibility to said fibers.

2. The method of claim 1, wherein said fibers are treated by being dispersed in an acidic aqueous solution containing the water soluble acid salt.

3. The method of claim 1, wherein said acid salt is selected from the group consisting of lactate and acetate.

4. The method of claim 1, wherein said fibers are treated by being dipped into a solution containing the acid salt or by spraying or applying the salt in a solution form to the fibers.

5. The method of claim 1, wherein said acid salt is used in an amount of 0.05 to 1.5% based on the weight of said fibers.

6. The method of claim 2, wherein the concentration of the acid salt in the aqueous solution is 10–100 ppm.

* * * * *